US006276325B1

(12) United States Patent
Arlton

(10) Patent No.: US 6,276,325 B1
(45) Date of Patent: Aug. 21, 2001

(54) GLOW PLUG CONNECTION FOR MODEL ENGINES

(76) Inventor: Paul E. Arlton, 1132 Anthrop Dr., West Lafayette, IN (US) 47906

( * ) Notice: Subject to any disclaimer, the term of this patent is extended or adjusted under 35 U.S.C. 154(b) by 0 days.

(21) Appl. No.: 09/463,519

(22) PCT Filed: Jul. 22, 1998

(86) PCT No.: PCT/US98/15105

§ 371 Date: Mar. 17, 2000

§ 102(e) Date: Mar. 17, 2000

(87) PCT Pub. No.: WO99/05455

PCT Pub. Date: Feb. 4, 1999

Related U.S. Application Data

(60) Provisional application No. 60/057,548, filed on Aug. 29, 1997, and provisional application No. 60/053,744, filed on Jul. 25, 1997.

(51) Int. Cl.[7] ..... F23Q 7/00

(52) U.S. Cl. ..... 123/145 A; 123/145 R; 123/DIG. 3

(58) Field of Search ..... 123/145 A, 145 R, 123/143 C, DIG. 3, 169 R, 169 PA; 219/270, 523, 553, 541; 439/668

(56) References Cited

U.S. PATENT DOCUMENTS 3,980,067 * 9/1976 Remington ..... 123/145 R
4,080,944 * 3/1978 Bhat et al. ..... 123/145 A
4,088,105 * 5/1978 Bhat et al. ..... 123/145 A
4,177,785 * 12/1979 Sundeen ..... 123/145 A
4,183,341 * 1/1980 Eastman ..... 123/DIG. 3
5,048,607 * 9/1991 Phelps et al. ..... 166/270
5,676,100 * 10/1997 Dam et al. ..... 123/145 A
5,682,865 * 11/1997 Maekawa et al. ..... 123/169 PA

FOREIGN PATENT DOCUMENTS

579487 * 1/1994 (EP) .
928936 * 4/1997 (JP) .

* cited by examiner

*Primary Examiner*—Tony M. Argenbright
*Assistant Examiner*—Hieu T. Vo
(74) *Attorney, Agent, or Firm*—Barnes & Thornburg

(57) ABSTRACT

A glow plug (10, 150, 170, 190, 250) is provided for use in a model engine 12 and for connecting to a glow plug clip (30). The glow plug (10, 150, 170, 190, 250) includes a coil (38) having spaced apart first and second ends (42, 44), a first conductor (34) coupled to the first end (42) of the coil (38), and a second conductor (40) coupled to the second end (44) of the coil (38). The second conductor (40) includes a body and a glow plug clip-retaining portion (32, 152, 172, 192, 252) and the glow plug clip-retaining portion is defined by an indentation (70, 72, 176, 196, 256) in the body.

68 Claims, 12 Drawing Sheets

GLOW PLUG CONNECTION FOR MODEL ENGINES

CROSS-REFERENCES TO RELATED APPLICATIONS

This application is a U.S. national application of international application Ser. No. PCT/US98/15105 filed Jul. 22, 1998, which claims priority to U.S. provisional applications Ser. Nos. 60/053,744 and 60/057,548 filed Jul. 25, 1997, and Aug. 29, 1997, respectively.

This invention relates to engines for model aircraft, cars, boats, and the like, and particularly to model engines having a glow-style ignition system. More particularly, the present invention relates to an improved connection between a model engine glow plug and a glow plug clip used to transmit electrical power from an energy supply to the glow plug when starting the model engine.

Most current-day engines used in model airplanes, cars, and boats are called "glow-ignition" engines because they rely on a hot, glowing platinum-alloy coil located within a combustion chamber of the engine to ignite an air/fuel mixture within the combustion chamber. The pressure developed by the burning air-fuel mixture typically displaces a piston which in turn drives a rotary output shaft thereby producing usable mechanical power. The fuel used in a glow-ignition engine is usually comprised of alcohol, castor oil, and nitromethane. Proper fuel combustion is maintained not only by the high temperature of the glowing platinum coil, but also by the catalyzing action of the platinum metal on the fuel/air mixture. The platinum coil in a glow-ignition engine burns out occasionally and so is generally manufactured as part of an assembly called a glow plug which can be easily removed from the engine and replaced.

According to the present invention, a glow plug including a glow plug clip-retaining portion is provided for use on model engines. The glow plug clip-retaining portion is an indentation or recess formed in a surface of the glow plug.

In a preferred embodiment, the glow plug clip-retaining portion is a circumferentially extending lip and a circumferentially extending slot formed on an exterior surface of the glow plug adjacent to the circumferentially extending lip. This circumferentially extending slot is receptive to a locking mechanism on a variety of popular conventional glow plug clips already in service.

A glow plug clip-engaging surface is provided on an upper end of the glow plug adjacent to the circumferentially extending lip to facilitate application of the glow plug clip to the glow plug. The holding and centering power of the glow plug clip-retaining portion is improved by sloping the sides of the circumferentially extending retaining slot thereby encouraging the glow plug clip to lock tightly to the center of the circumferentially extending retaining slot or to the back side of the circumferentially extending retaining lip.

In preferred embodiments, the glow plug clip-retaining portion is circular in cross section and manufactured easily on automatic screw machines. In addition, in preferred embodiments, the glow plug clip-retaining portion can be used on glow plugs of a variety of sizes and configurations.

Additional features and advantages of the invention will become apparent to those skilled in the art upon consideration of the following detailed description of preferred embodiments which exemplify the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
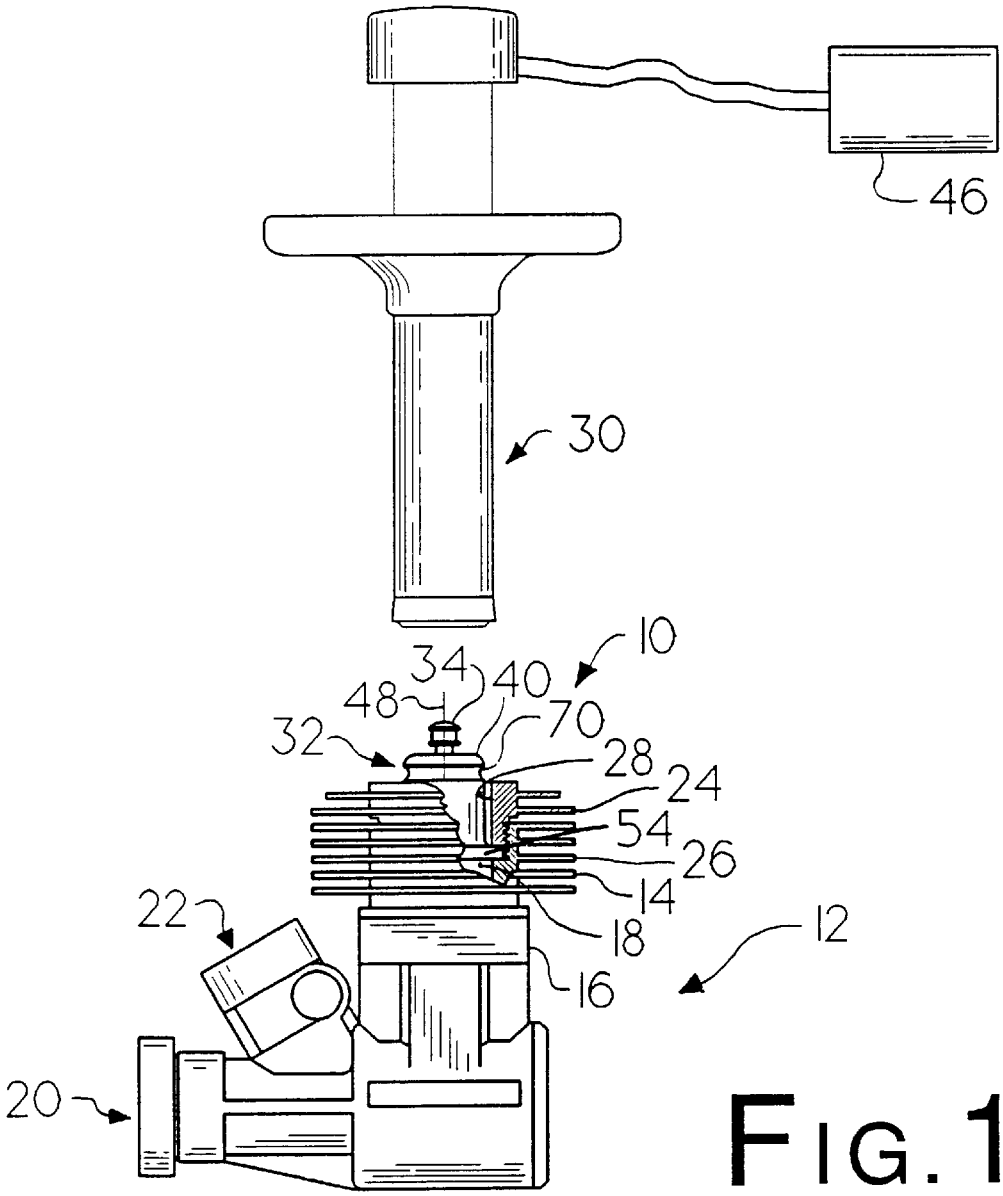
FIG. 1 is a side elevational view, with portions cutaway, of a glow plug positioned to lie in a model engine and a glow plug clip that provides electrical current to the glow plug.

A glow plug 10 for use on a model engine 12 is shown in FIG. 1. The engine 12 includes a heat sink 14, an engine cylinder 16, a combustion chamber 18, an output shaft 20, and a carburetor 22. The heat sink 14 includes first and second heat sink portions 24, 26 that threadingly engage each other and a glow plug-receiving aperture 28 extending through first heat sink portion 24. Glow plug 10 is positioned to lie in glow plug-receiving aperture 28 and is secured between first and second heat sink portions 24, 26 as shown in FIG. 1.

A glow plug clip 30 is also shown in FIG. 1. Glow plug clip 30 is adapted to engage glow plug 10 to provide an electric current through glow plug 10 as shown, for example in FIGS. 4 and 5. The electric current causes combustion of an air/fuel mixture that is present in combustion chamber 18 of model engine 12.

Figure 2:
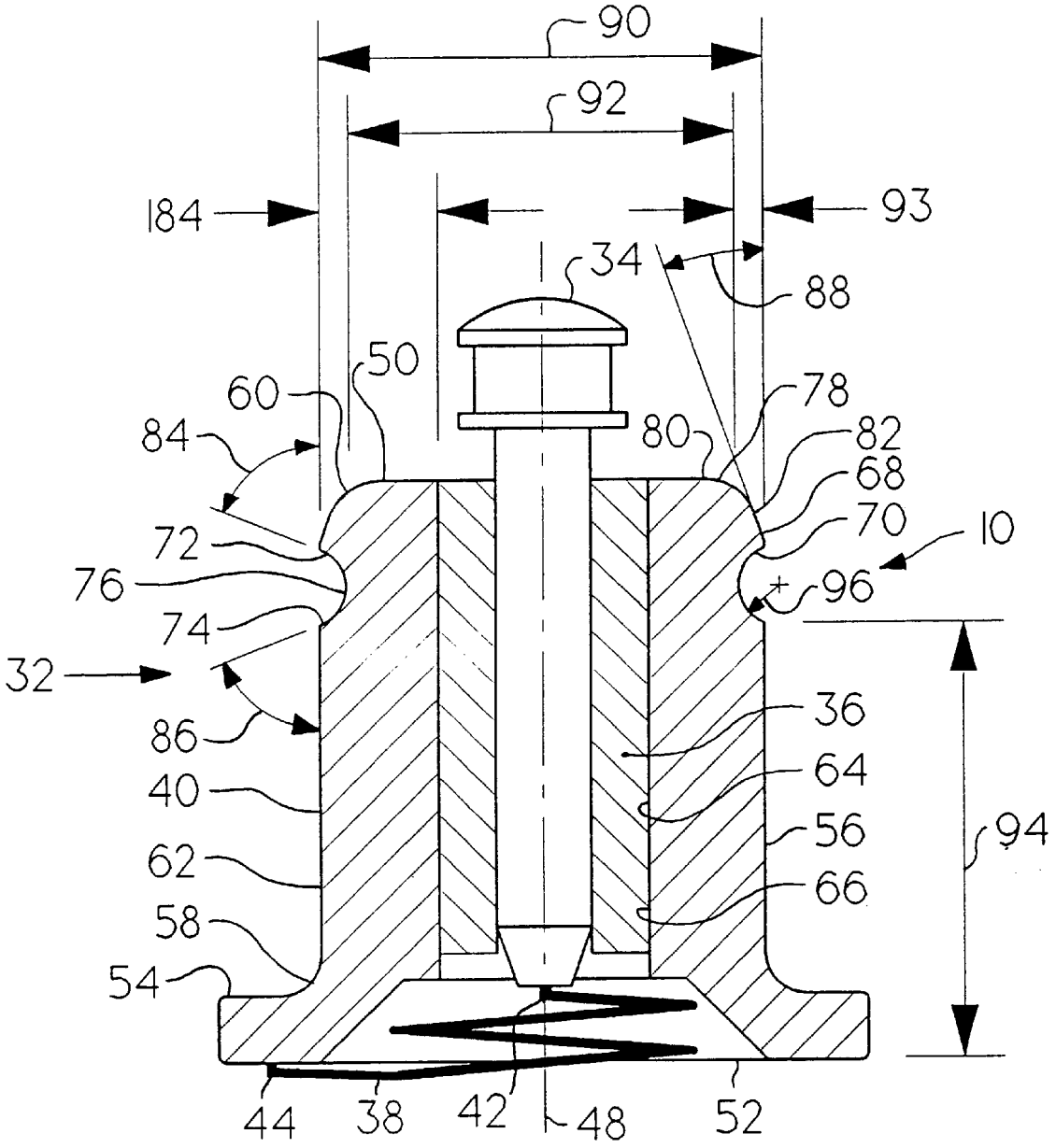
FIG. 2 is a partial sectional view of a glow plug showing the glow plug being formed to include a circumferentially extending retaining slot and a circumferentially extending retaining lip that define a glow plug clip-retaining portion in accordance with the current invention.

As shown in FIG. 2, glow plug 10 is generally round in cross section and includes a glow plug clip-retaining portion 32, an inner pole or conductor 34, an electrical insulator 36, a coil or conductor 38, and a body or outer conductor 40. In preferred embodiments, coil 40 is formed of a platinum-alloy wire and includes a first end 42 connected to inner pole 34 and a second end 44 connected to body 40. Application of a voltage to inner pole 34 and body 40, as may be developed by an electric battery 46, induces an electric current through coil 38 causing coil 38 to glow at a very high temperature. When situated within combustion chamber 18 of model engine 12, glowing coil 38 can initiate the combustion of the air/fuel mixture in combustion chamber 18. The platinum-alloy of coil 38 operates to catalyze and maintain the air/fuel combustion reaction after electric battery 46 is disconnected from coil 38.

Body 14 extends along a longitudinal axis 48 and includes a top end 50, a bottom end 52, a mounting flange 54 positioned to lie at bottom end 52, a cylindrical side wall 56 having a lower end 58 connected to mounting flange 54 and an upper end 60 positioned to lie at top end 50, an outer surface 62 facing away from longitudinal axis 48, and an inner surface 64 defining an inner pole-receiving aperture 66 extending between top end 50 and bottom end 52 as shown, for example, in FIG. 2. Inner pole 34, electrical insulator 36, and coil 38 extend through portions of inner pole-receiving aperture 66. The mounting flange 54 is positioned to lie between first and second heat sink portions 24, 26 as shown in FIG. 1. First heat sink portion 24 may also be referred to as a clamp ring because it screws downwardly onto mounting flange 54 to secure glow plug 10 to model engine 12.

Glow plug clip-retaining portion 32 is defined by an indentation or recess in cylindrical side wall 56. More specifically, glow plug clip-retaining portion 32 is defined by a circumferentially extending retaining lip 68 formed in cylindrical side wall 56 of body 40 and a circumferentially extending retaining slot 70 formed in cylindrical side wall 56 adjacent to circumferentially extending retaining lip 68. The circumferentially extending retaining slot 70 is defined by spaced-apart first and second slot walls 72, 74 that converge inwardly toward longitudinal axis 48 to a center 76 of circumferentially extending retaining slot 70. First slot wall 72 extends between circumferentially extending lip 68 and center 76, and second slot wall 74 extends from center 76 away from inner surface 64 and toward bottom end 52 as shown, for example, in FIG. 2.

The circumferentially extending retaining lip 68 is positioned to lie between top end 50 and circumferentially extending retaining slot 70. The body 40 further includes a glow plug clip-engaging surface 78 having a first end 80 positioned to lie adjacent to top end 50 and a second end 82 positioned to lie adjacent to circumferentially extending retaining lip 68. The glow plug clip-engaging surface 78 is angled with respect to longitudinal axis 48 so first end 80 is positioned to lie between second end 82 and longitudinal axis 48.

First and second slot walls 72, 74 extend relative to longitudinal axis 48 along slot wall angles 84, 86, respectively, and glow plug clip-engaging surface 78 extends relative to longitudinal axis 48 along glow plug clip-engaging surface angle 88. First and second slot walls 72, 74 cooperate to define a semicircle having a slot radius 96. In preferred embodiments of the present invention, body 40 includes an outer diameter 90 of about 0.33 inch (0.84 cm) to 0.35 inch (0.89 cm), a slot diameter 92 of about 0.295 inch (0.75 cm) to 0.325 inch (0.83 cm), and a height 94 between bottom end 52 of body 40 and circumferentially extending retaining slot 70 of about 0.33 inch (0.84 cm) or more. Slot radius 96 is about 0.03 inch (0.08 cm). The circumferentially extending retaining slot 70 includes a slot depth 93 of about 0.02 inch (0.5 mm) deep, glow plug clip-engaging surface angle 88 is about 20 degrees, and slot wall angles 84, 86 are about 68 degrees.

Figure 3:
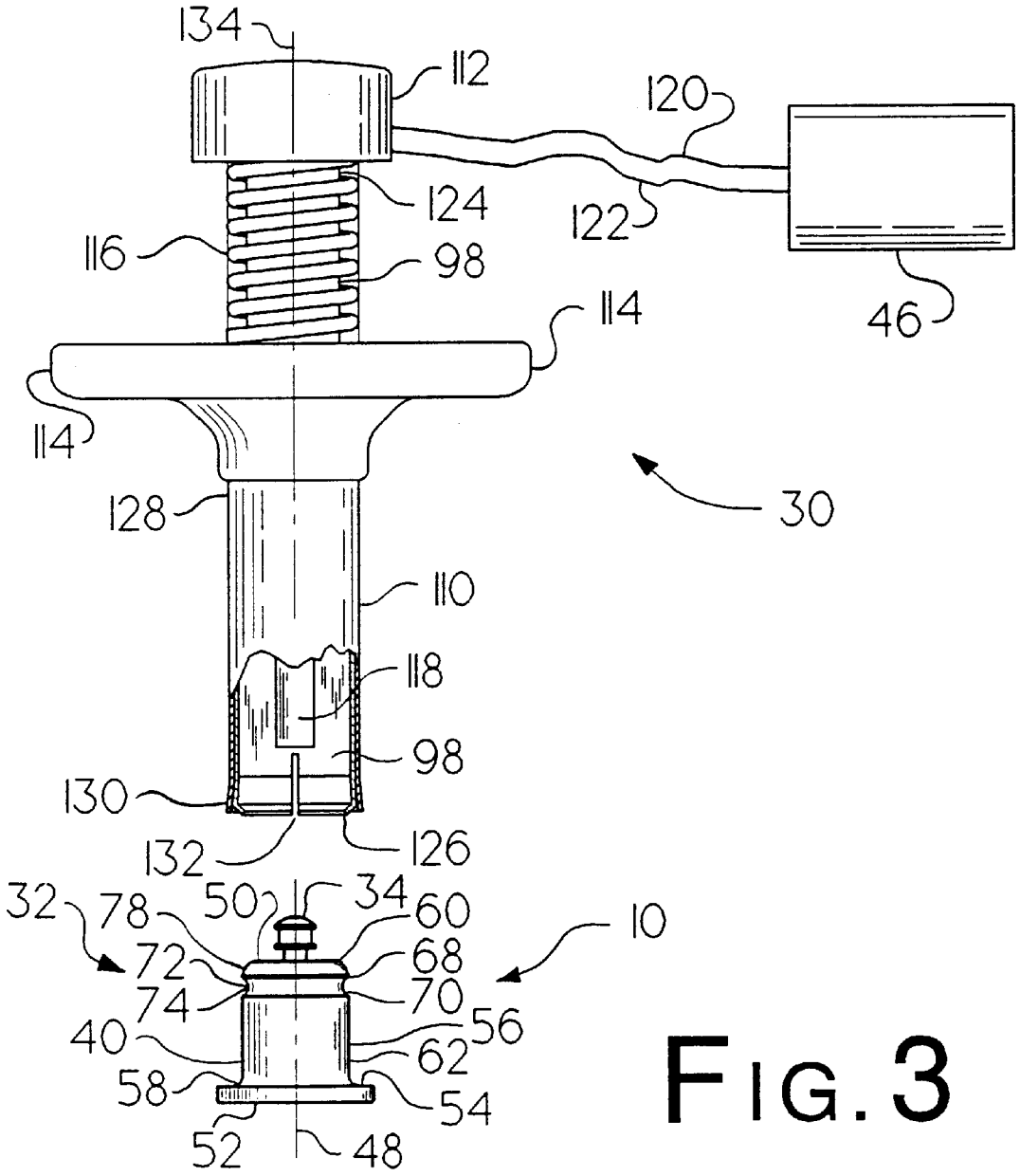
FIG. 3 is a side elevation view, with portions cutaway, of the glow plug clip and glow plug shown in FIGS. 1 and 2.
Figure 4:
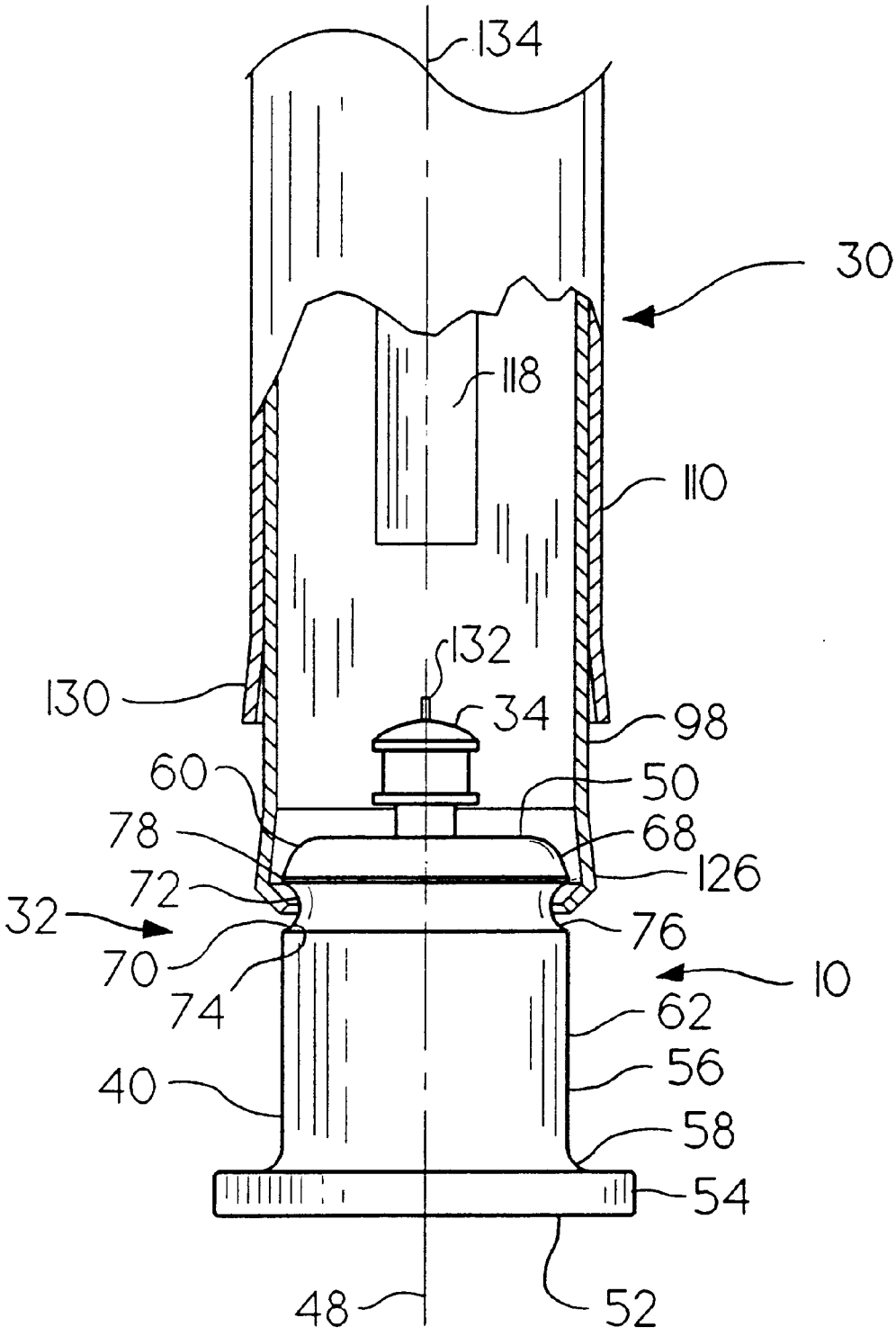
FIG. 4 is an enlarged side elevation view, with portions cutaway, of the glow plug clip shown in FIG. 3 partially engaging the glow plug clip-retaining portion of the glow plug shown in FIG. 3.
Figure 5:
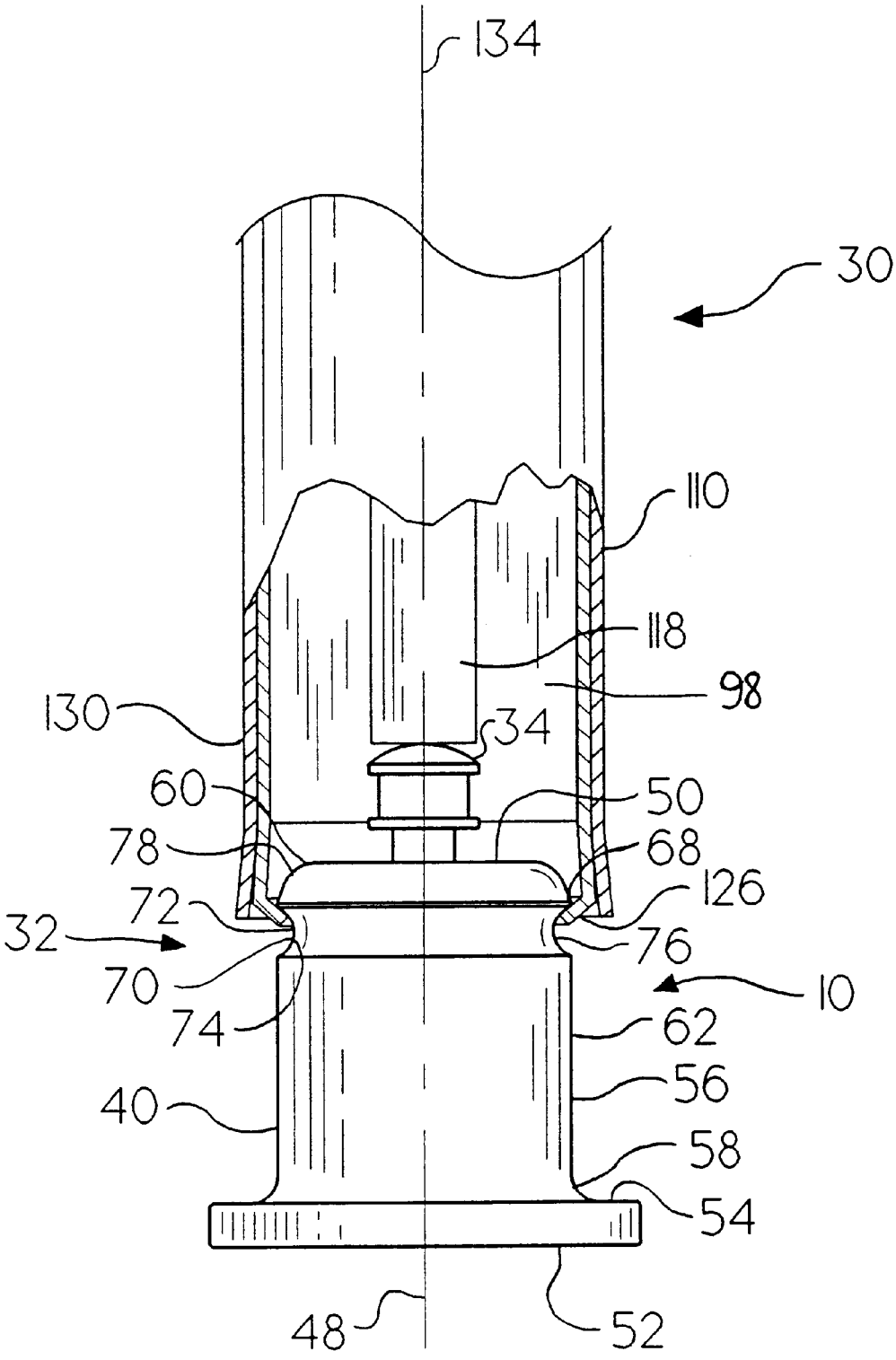
FIG. 5 is an enlarged side elevation view, with portions cutaway, of the glow plug clip shown in FIGS. 3 and 4 fully engaging the glow plug clip-retaining portion of the glow plug.

FIGS. 3–5 illustrate the application of a glow plug clip 30 to glow plug 10. As shown in FIG. 3, glow plug clip 30 has an inner sleeve 98, which is generally round in cross section, an outer sleeve 110, a thumb button 112 connected to inner sleeve 98, a finger grip 114 connected to outer sleeve 110, a spring 116 extending between thumb button 112 and finger grip 114, and a longitudinal axis 134. Inner sleeve 98 includes a first end 124 connected to thumb button 128 and a second or collect end 126 spaced apart from first end 124. Outer sleeve 110 includes a first end 128 connected to finger grip 114 and a second end 130 spaced apart from the first end 128. A user may move outer sleeve 110 relative to inner sleeve 98 by gripping thumb button 112 and finger grip 114 and compressing spring 116. Glow plug clip 30 further includes an inner post 118 and electrical wires 120, 122 connected to a battery 46 and to each of inner sleeve 98 and inner post 118.

To attach glow plug clip 30 to glow plug 10, an operator of a model engine 12 holds glow plug clip 30 in one hand with the index and ring finger positioned below finger grip 114 and thumb pressing on thumb button 112. When the operator presses thumb button 112 toward finger grip 114, collect end 126 of inner sleeve 98 extends downward relative to second end 130 of outer sleeve 110 as shown in FIG. 4. Collect end 126 of inner sleeve 98 is formed to include a plurality of longitudinal slits 132 that allow collect end 126 of inner sleeve 98 to expand slightly to accommodate entry of glow plug 10 within inner sleeve 98. Glow plug clip-engaging surface 78 of glow plug 10 facilitates entry of upper end 60 of glow plug 10 into inner sleeve 98 of glow plug clip 30 by centering and expanding collect end 126 of inner sleeve 98 around upper end 60 of glow plug 10.

As shown in FIG. 5, when the operator releases thumb button 112 and finger grip 114, return spring 116 (shown in FIG. 3) pushes outer sleeve 110 downward away from thumb button 112 over collect end 126 of inner sleeve 98 to secure glow plug 10 inside of glow plug clip 30 where inner pole 34 of glow plug 10 makes electrical contact with inner post 118. Second end 130 of outer sleeve 110 is tapered slightly and compresses collect end 126 of inner sleeve 98 into glow plug clip-retaining portion 32 of glow plug 10 as outer sleeve 110 is pushed downward over collect end 126 of inner sleeve 98 thereby locking glow plug clip 30 onto glow plug 10. Electrical current from a battery 46 passes serially through electrical wire 120, inner post 118, inner pole 34, coil 38, body portion 40, inner sleeve 98, and electrical wire 122 when starting model engine 12 having glow plug 10.

As discussed above, first and second slot walls 72, 74 are defined by slot wall angles 84, 86, respectively. In alternative embodiments of the present invention, a square-shaped glow plug clip-retaining slot (a slot with first and second slot wall angles set to ninety degrees relative to the longitudinal axis) could adequately retain a glow plug clip on a glow plug. First and second slot walls 72, 74 induce collect end 126 of inner sleeve 98 of glow plug clip 30 to slide toward center 76 of circumferentially extending retaining slot 70 thereby producing a positive locking action. With collect end 126 of inner sleeve 98 of glow plug clip 30 centered within circumferentially extending retaining slot 70, longitudinal axis 134 of glow plug clip 30 and longitudinal axis 48 of glow plug 10 are maintained in substantially collinear relation as shown, for example, in FIG. 5. Second slot wall 74 assists in maintaining longitudinal axis 134 of glow plug clip 30 and longitudinal axis 48 of glow plug 10 in substantially collinear relation. First slot wall 72 of circumferentially extending retaining slot 70 also facilitates removal of glow plug clip 30 from glow plug 10 by expanding collect end 126 of inner sleeve 98 when inner sleeve 98 is pulled away from glow plug 10.

Figure 6:
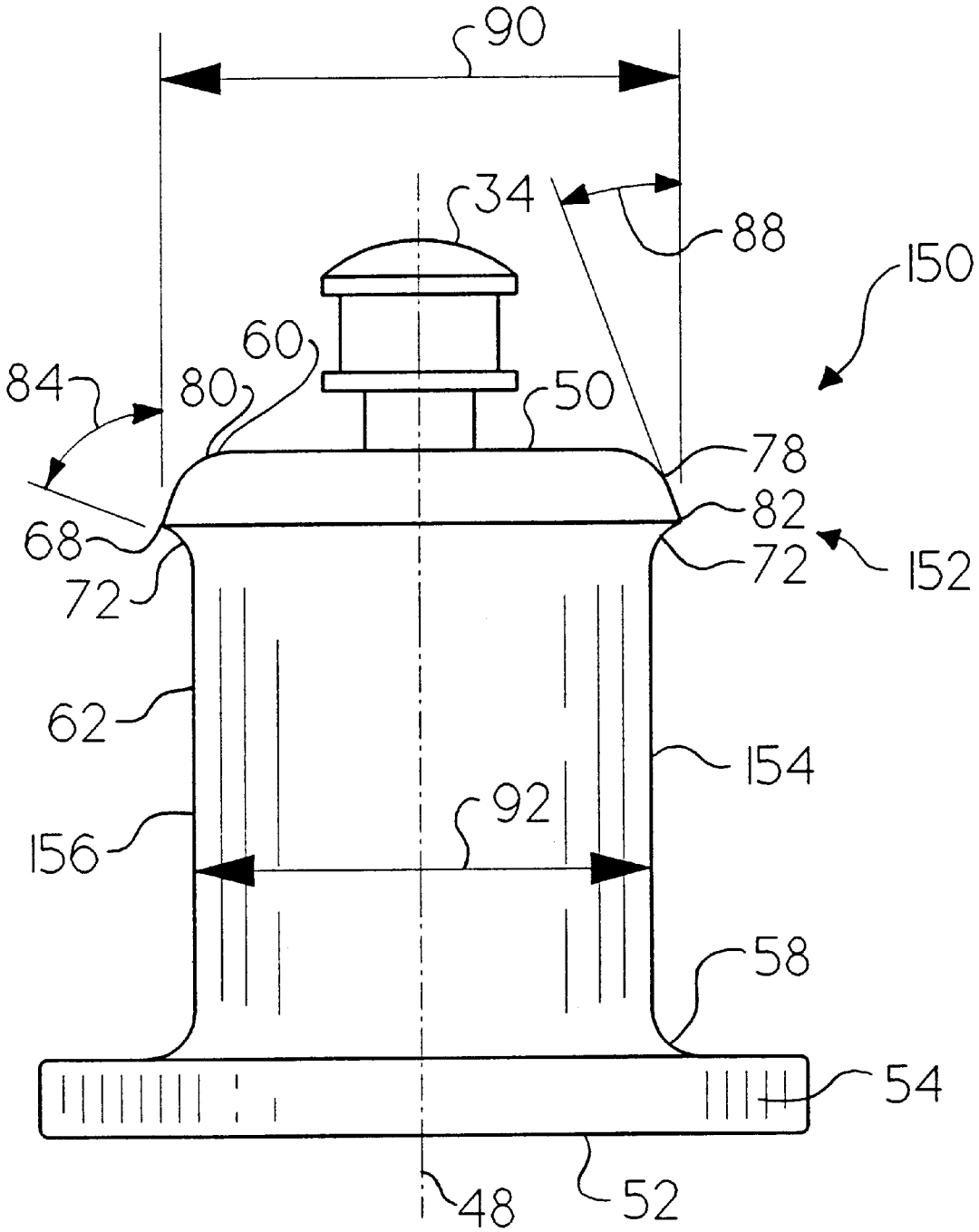
FIG. 6 is a side elevational view of another preferred embodiment of a glow plug showing the glow plug having a glow plug clip-retaining portion defined by circumferentially extending retaining lip and a circumferentially extending retaining slot.

Another preferred embodiment of a glow plug 150 having a glow plug clip-retaining portion 152 and body 154 is shown in FIG. 6. Glow plug 150 is identical to glow plug 10 except for glow plug clip-retaining portion 152 and body 154. Components of glow plug 150 that are identical to components of glow plug 10 are identified with identical reference numbers.

Glow plug clip-retaining portion 152 of glow plug 150 is identical to glow plug clip-retaining portion 32 of glow plug 10 except that glow plug clip-retaining portion 152 does not include second slot wall 74 found in glow plug 10. Glow plug clip-retaining portion 152 is defined by an indentation provided by first slot wall 72.

Accordingly, body 154 of glow plug 150 includes a cylindrical side wall 156 that includes diameter 92 between mounting flange 54 and glow plug clip-retaining portion 152 instead of diameter 90 as in cylindrical side wall 56 of body 40 of glow plug 10. Glow plug 150 does not include a second slot wall 74 as found in glow plug 10 because it is not required to retain glow plug clip 30 on glow plugs 10, 150.

Figure 7:
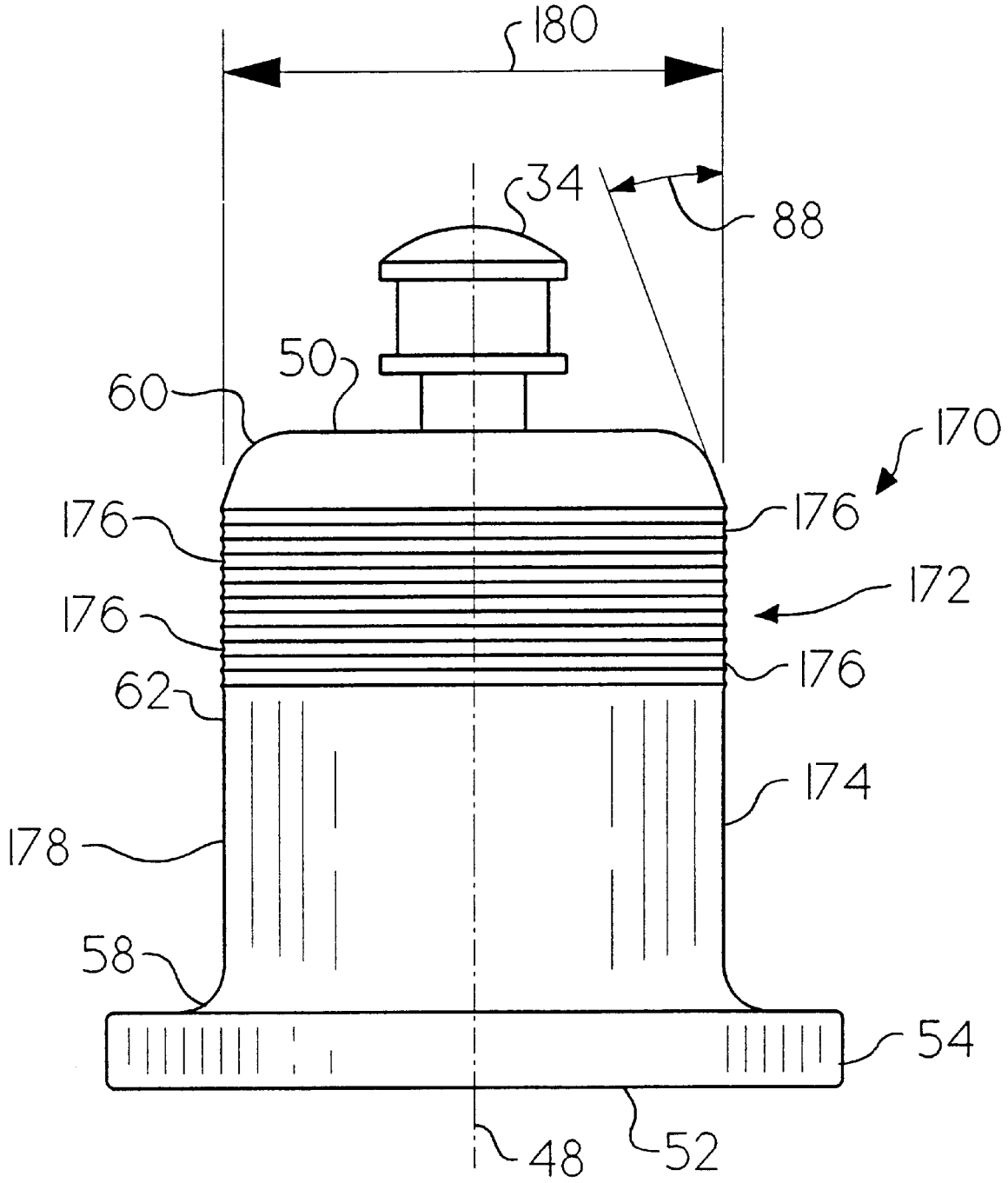
FIG. 7 is a side elevational view of yet another preferred embodiment of a glow plug showing the glow plug having a glow plug clip-retaining portion defined by a plurality of shallow annular grooves formed in the glow plug body.
Figure 8:
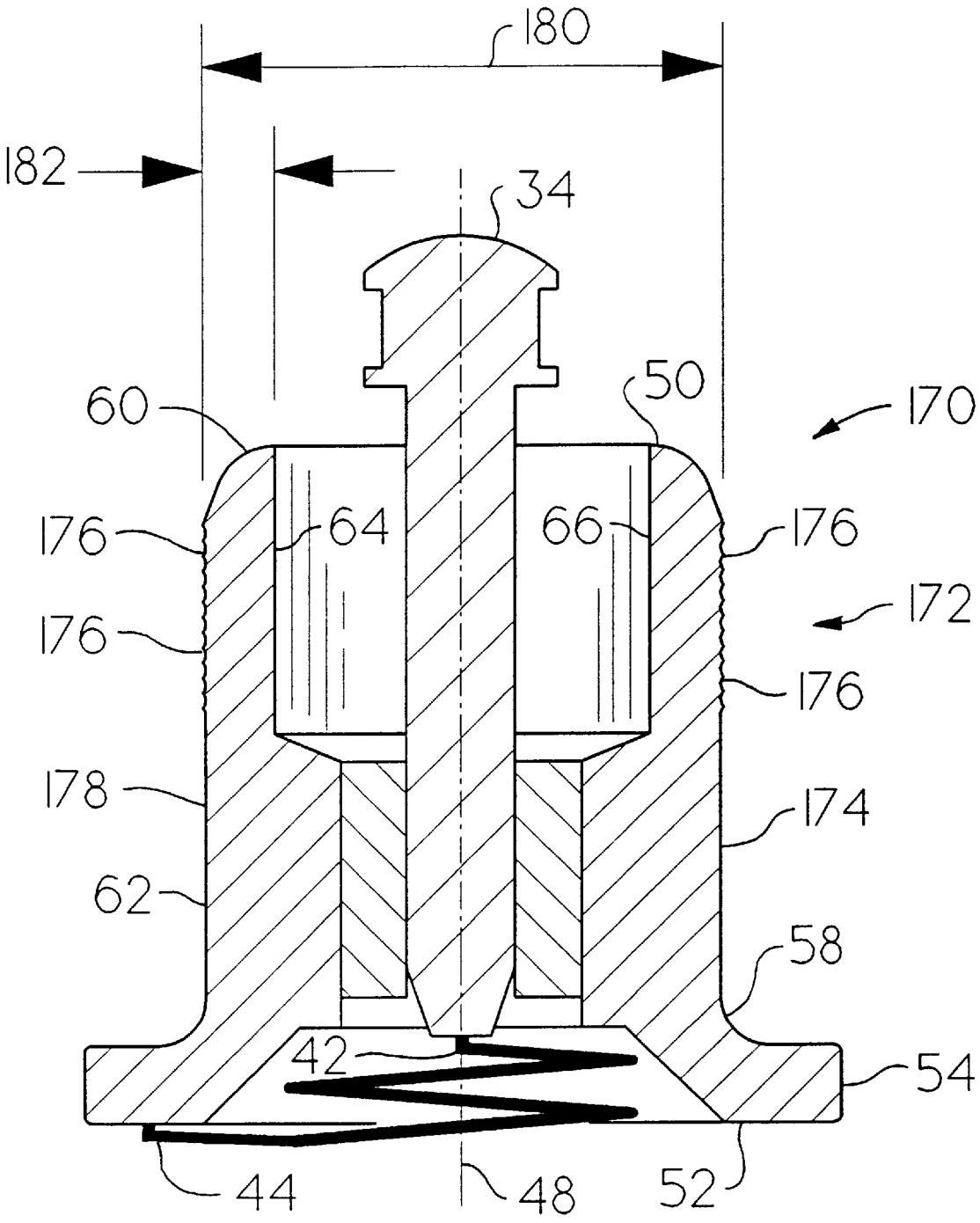
FIG. 8 is a sectional view of the glow plug of FIG. 7.

Another preferred glow plug 170 having a glow plug clip-retaining portion 172 and body 174 is shown in FIGS. 7 and 8. Glow plug 170 is identical to glow plugs 10, 150 except that glow plug clip-retaining portion 172 and body 174 are different from glow plug clip-retaining portions 32, 152 and bodies 40, 154. Components of glow plug 170 that are identical to components of glow plugs 10, 150 are identified with identical reference numbers.

Glow plug clip-retaining portion 172 includes an indentation or recess in the form of a plurality of circumferentially extending grooves 176 formed in body 174. The plurality of circumferentially extending grooves 176 are receptive to collect end 126 of inner sleeve 98 of glow plug clip 30. The plurality of circumferentially extending grooves 176 does not extend inwardly toward longitudinal axis 48 as far as first and second angled slot walls 72, 74 of glow plugs 10, 150. Body 174 of glow plug 170 includes a cylindrical side wall 178 having an outer diameter 180 equal to outer diameter 90 of glow plugs 10, 150, however, cylindrical side 178 includes a thickness 182 that is less than a thickness 184 of cylindrical side wall 56 as shown, for example, in FIGS. 2 and 8. The thin cylindrical side wall 178 of glow plug 170 permits more room for inner pole 34 and reduces the weight of glow plug 170.

The plurality of circumferentially extending grooves 176 may be formed, for example, during a cutting or knurling operation. The plurality of circumferentially extending grooves 176 may be in the form of annular rings, as shown in FIGS. 7 and 8, or spiral thread-like grooves (not shown).

Figure 9:
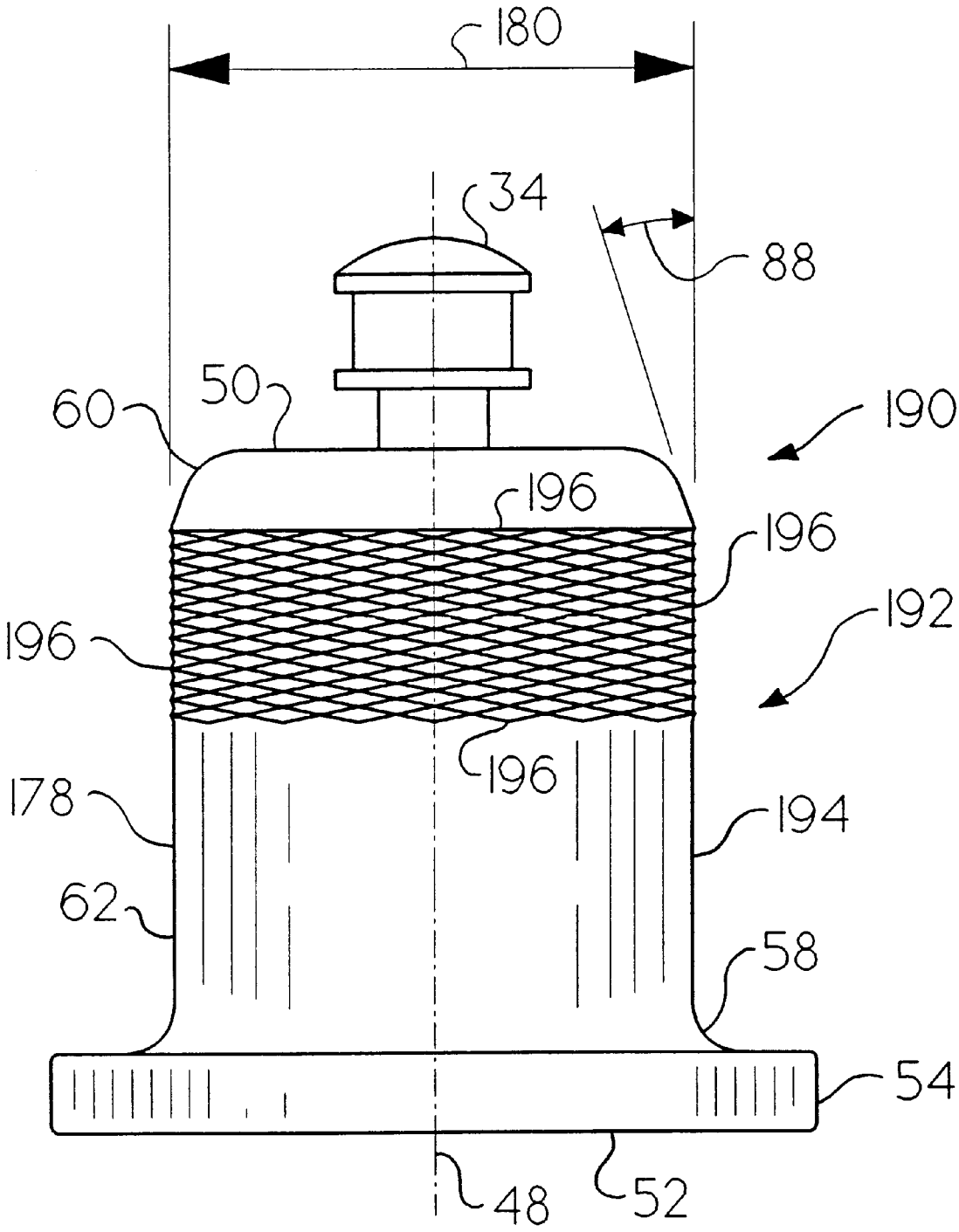
FIG. 9 is a side elevational view of yet another preferred embodiment of a glow plug showing the glow plug having a glow plug clip-retaining portion defined by a diamond knurl pattern.

Another preferred glow plug 190 having a glow plug clip-retaining portion 192 and body 194 is shown in FIG. 9. Glow plug 190 is identical to glow plug 170 except that glow plug clip-retaining portion 192 is defined by indentations or diamond knurl patterns 196 formed in body 194 of glow plug 190 as shown in FIG. 9. Components of glow plug 190 that are identical to components of glow plug 170 are identified with identical reference numbers.

In the drawings, glow plugs 10, 150, 170, 190 are compatible with certain commercially available glow plug clips such as the KwikKlip II™ manufactured by DuBro Manufacturing Company of Wauconda, Ill.

Figure 10:
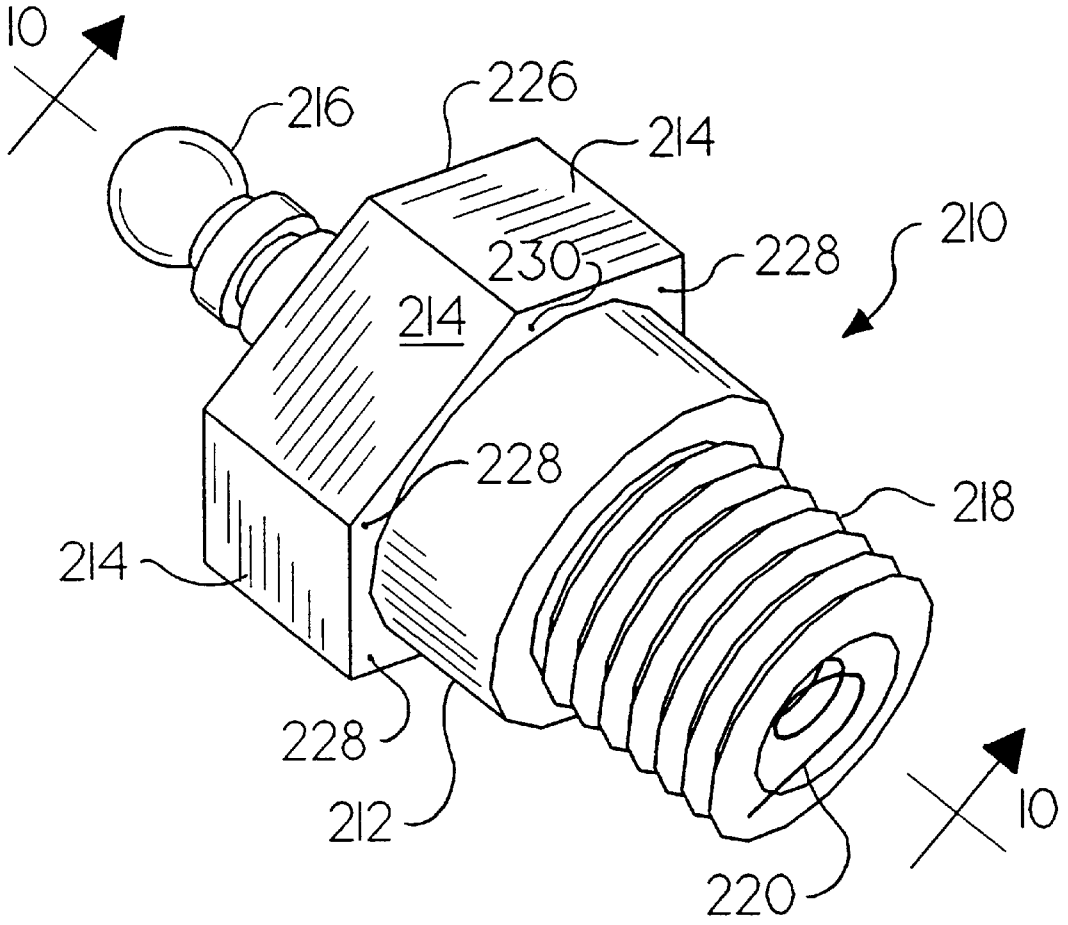
FIG. 10 is a perspective view of a glow plug for use with relatively large model engines showing the glow plug having hexagonal wrench flats and a threaded base.
Figure 11:
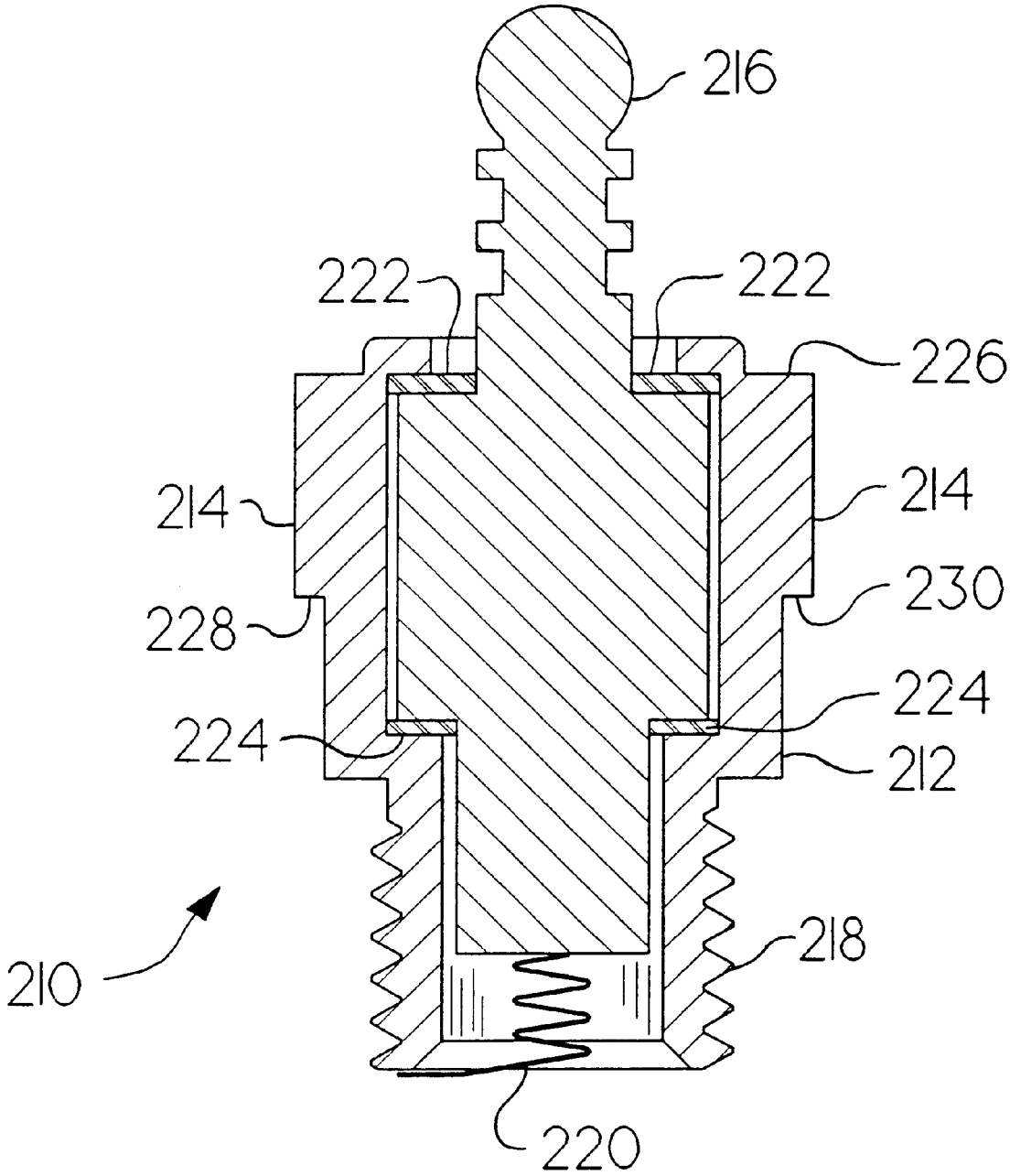
FIG. 11 is a sectional view of the glow plug of FIG. 10, taken along line 11—11 of FIG. 10.

While glow plugs 10, 150, 170, 190 are generally intended for use with small model engines 12 below about 0.10 cubic inch (1.6 cubic centimeters) displacement, other glow plugs, such as an OS No. 8 glow plug produced by OS Engines of Japan is designed for larger model engines (not shown). Glow plug 210, shown in FIGS. 10 and 11, is illustrative of the OS No. 8 Glow Plug. Glow plug 210 has body portion 212, hexagonal wrench flats 214, inner pole 216, threaded section 218, and coil 220. Coil 220 extends between and is attached to inner pole 216 and body 212. As shown in FIG. 11, glow plug 210 has electrical insulators 222, 224 separating inner pole 216 from body 212 so that a voltage applied to inner pole 216 and body 212 induces a current in coil 220. Wrench flats 214 are provided to engage a wrench or other tool when tightening or loosening glow plug 210 in a model engine.

Currently available glow plug clips, such as glow plug clip 30 shown in FIGS. 1 and 3, must slide over an upper end 226 of wrench flats 214 to lock onto corners 228 positioned to lie on a lower end 230 of wrench flats 214. The maximum radial size of wrench flats 214 is therefore constrained by the inside dimensions of inner sleeve 98 of glow plug clip 30. In some applications, such as on very large model engines and specialty racing engines, it is desirable to manufacture a glow plug from a large diameter bar stock, in which case the radial dimensions of the wrench flats may exceed the allowable size of standard glow plug clips.

Figure 12:
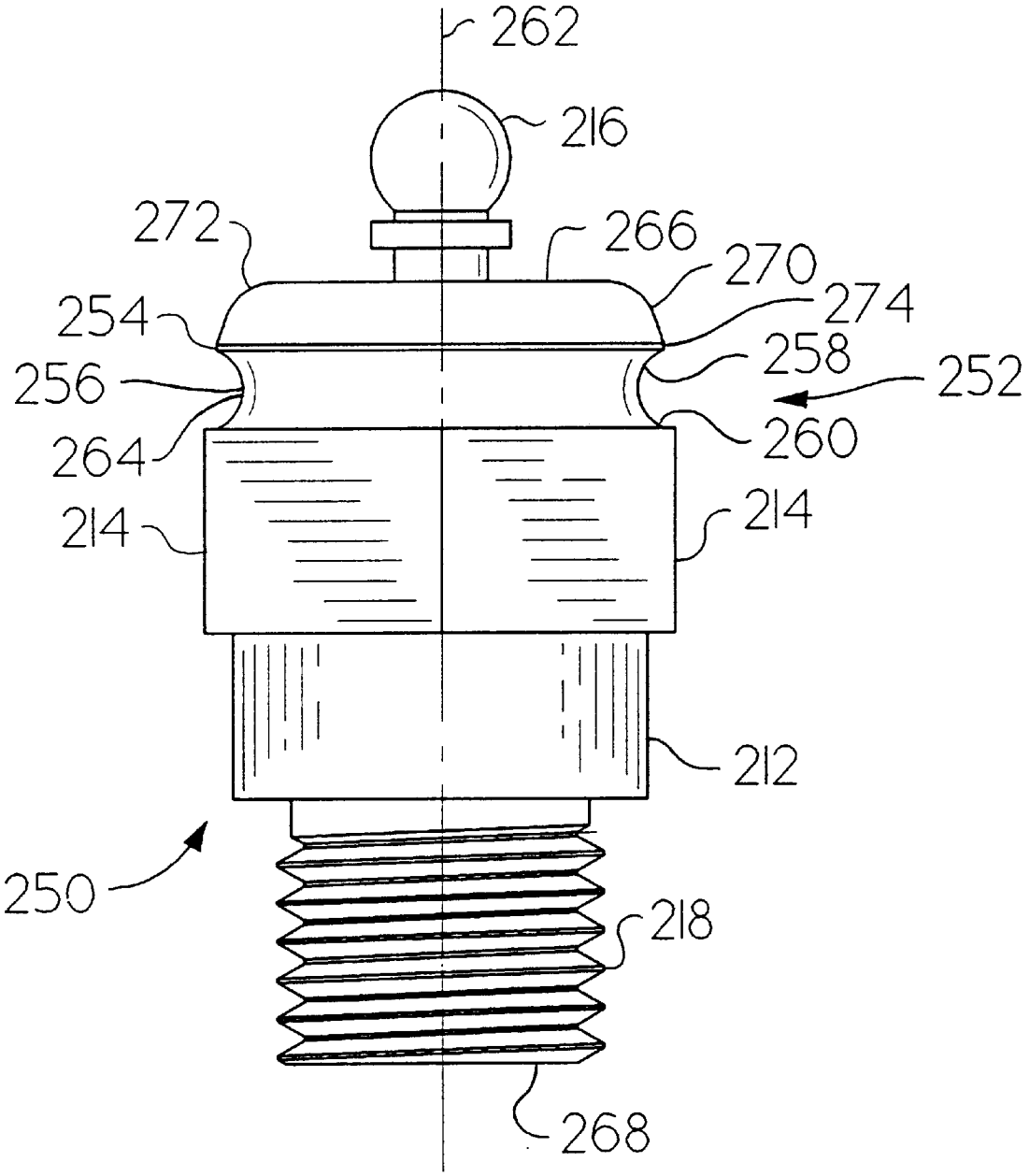
FIG. 12 is a side elevation view of a glow plug similar to the glow plug shown in FIGS. 10 and 11 showing the glow plug including a glow plug clip-retaining portion.

A glow plug 250 configured in accordance with the current invention for use with larger model engines is shown in FIG. 12. Glow plug 250 is identical to glow plug 210 except that glow plug 250 includes a glow plug clip-retaining portion 252 appended to upper end 226 of wrench flats 214. The glow plug clip-retaining portion 252 is defined by an indentation or recess in body 212. The glow plug clip-retaining portion 252 includes a circumferentially extending retaining lip 254 formed in body 212 and a circumferentially extending retaining slot 256 formed in body 212 adjacent to circumferentially extending retaining lip 254. The circumferentially extending retaining slot 256 is defined by first and second slot walls 258, 260 that converge inwardly toward longitudinal axis 262 to a center 264 of circumferentially extending retaining slot 256. First slot wall 258 extends between circumferentially extending retaining lip 254 and center 264, and second slot wall 260 extends from center 264 away from longitudinal axis 262 and toward wrench flats 214 as shown in FIG. 12.

The body 212 further includes a top end 266, a bottom end 268, and a glow plug clip-engaging surface 270 having a first end 272 positioned to lie adjacent to top end 266 and a second end 274 positioned to lie adjacent to circumferentially extending retaining lip 254. The glow plug clip-engaging surface 270 is angled with respect to longitudinal axis 262 so first end 272 is positioned to lie between second end 274 and longitudinal axis 262.

Glow plug clip-retaining portion 252 is separated from wrench flats 214, so the size of wrench flats 214 has no operational effect on the application of a glow plug clip 30 to glow plug 250. In alternative embodiments of the present invention, glow plug clip-retaining portions similar to glow plug clip-retaining portions 152, 172, shown in FIGS. 6–8, may be appended to the upper end of the wrench flats.

Although this invention has been described in detail with reference to certain embodiments, variations and modifications exist within the scope and spirit of the invention as described and defined in the following claims.

What is claimed is:

1. A glow plug for use in a model engine and for connecting to a glow plug clip, the glow plug comprising a conductor, and a body coupled to the conductor, the body including a glow plug clip-retaining portion defined by an indentation.

2. The glow plug of claim 1, wherein the indentation is a semi-circular shaped groove in the body.

3. The glow plug of claim 1, wherein the indentation is a plurality of grooves in the body.

4. The glow plug of claim 3, wherein the plurality of grooves extends circumferentially around the body.

5. The glow plug of claim 1, wherein the body includes an outer surface facing away from the longitudinal axis, a top end, a bottom end, and a first slot wall, the first slot wall includes spaced-apart first and second ends, the first slot wall extends along an angle so that the second end of the first slot wall is positioned to lie between the first end of the first slot wall and the longitudinal axis, and the first slot wall defines the indentation.

6. The glow plug of claim 5, wherein the body further includes a second slot wall that includes spaced-apart first and second ends, the second slot wall extends along an angle so that the second end of the second slot wall is positioned to lie between the first end of the first slot wall and the longitudinal axis, and the first and second slot walls define the indentation.

7. The glow plug of claim 6, wherein the second ends of the first and second slot walls converge at a center of the indentation.

8. The glow plug of claim 5, wherein the body further includes a retaining lip positioned to lie between the top end of the body and the first end of the first slot wall.

9. The glow plug of claim 5, wherein the body further includes a glow plug clip-engaging surface having spaced-apart first and second ends, the second end of the glow plug clip-engaging surface is positioned to lie between the longitudinal axis and the first end of the glow plug clip-engaging surface.

10. The glow plug of claim 9, wherein the second end of the glow plug clip-engaging surface is contiguous with the top end of the body.

11. The glow plug of claim 9, wherein the body further includes a retaining lip positioned to lie between the first end of the first slot wall and the first end of the glow plug clip-engaging surface.

12. The glow plug of claim 1, wherein the indentation extends circumferentially about the body.

13. The glow plug of claim 1, wherein the indentation that defines the glow plug clip-retaining portion is spaced apart from the inner pole.

14. The glow plug of claim 1, wherein the body includes a mounting flange adapted to mount to a model engine and the indentation that defines the glow plug clip-retaining portion is spaced apart from the mounting flange.

15. The glow plug of claim 1, wherein the body includes a threaded portion adapted to mount to a model engine.

16. The glow plug of claim 1, wherein the indentation is a knurl.

17. The glow plug of claim 1, wherein the body includes an outer diameter of about 0.33 inch (0.84 cm) to 0.35 inch (0.89 cm).

18. The glow plug of claim 1, wherein the indentation defines a slot diameter of the body of about 0.295 inch (0.75 cm) to 0.325 inch (0.83 cm).

19. A glow plug for use in a model engine and for connecting to a glow plug clip, the glow plug comprising a conductor, and a body coupled to the conductor, the body including an outer surface and glow plug clip-retaining portion extending circumferentially about the outer surface.

20. The glow plug of claim 19, wherein the indentation is a semicircular shaped groove in the body.

21. The glow plug of claim 19, wherein the indentation is a plurality of grooves in the body.

22. The glow plug of claim 19, wherein the body includes an outer surface facing away from the longitudinal axis, a top end, a bottom end, and a first slot wall, the first slot wall includes spaced-apart first and second ends, the first slot wall extends along an angle so that the second end of the first slot wall is positioned to lie between the first end of the first slot wall and the longitudinal axis, and the first slot wall defines the indentation.

23. The glow plug of claim 22, wherein the body further includes a second slot wall that includes spaced-apart first and second ends, the second slot wall extends along an angle so that the second end of the second slot wall is positioned to lie between the first end of the first slot wall and the longitudinal axis, and the first and second slot walls define the indentation.

24. The glow plug of claim 23, wherein the second ends of the first and second slot walls converge at a center of the indentation.

25. The glow plug of claim 22, wherein the body further includes a retaining lip positioned to lie between the top end of the body and the first end of the first slot wall.

26. The glow plug of claim 22, wherein the body further includes a glow plug clip-engaging surface having spaced-apart first and second ends, the second end of the glow plug clip-engaging surface is positioned to lie between the longitudinal axis and the first end of the glow plug clip-engaging surface.

27. The glow plug of claim 26, wherein the second end of the glow plug clip-engaging surface is contiguous with the top end of the body.

28. The glow plug of claim 26, wherein the body further includes a retaining lip positioned to lie between the first end of the first slot wall and the first end of the glow plug clip-engaging surface.

29. The glow plug of claim 19, wherein the indentation that defines the glow plug clip-retaining portion is spaced apart from the inner pole.

30. The glow plug of claim 19, wherein the body includes a mounting flange adapted to mount to a model engine and the indentation that defines the glow plug clip-retaining portion is spaced apart from the mounting flange.

31. The glow plug of claim 19, wherein the body includes a threaded portion adapted to mount to a model engine.

32. The glow plug of claim 19, wherein the indentation is a knurl.

33. The glow plug of claim 19, wherein the body includes an outer diameter of about 0.33 inch (0.84 cm) to 0.35 inch (0.89 cm).

34. The glow plug of claim 19, wherein the indentation defines a slot diameter of the body of about 0.295 inch (0.75 cm) to 0.325 inch (0.83 cm).

35. A glow plug for use in a model engine and for connecting to a glow plug clip, the glow plug comprising a coil having spaced apart first and second ends, a first conductor coupled to the first end of the coil, and a second conductor coupled to the second end of the coil, the second conductor including a body and a glow plug clip-retaining portion, and the glow plug clip-retaining portion being defined by an indentation in the body.

36. The glow plug of claim 35, wherein the indentation is a semi-circular shaped groove in the body.

37. The glow plug of claim 35, wherein the indentation is a plurality of grooves in the body.

38. The glow plug of claim 37, wherein the plurality of grooves extend circumferentially around the body.

39. The glow plug of claim 35, wherein the body includes an outer surface facing away from the longitudinal axis, a top end, a bottom end, and a first slot wall, the first slot wall includes spaced-apart first and second ends, the first slot wall extends along an angle so that the second end of the first slot wall is positioned to lie between the first end of the first slot wall and the longitudinal axis, and the first slot wall defines the indentation.

40. The glow plug of claim 39, wherein the body further includes a second slot wall that includes spaced-apart first and second ends, the second slot wall extends along an angle so that the second end of the second slot wall is positioned to lie between the first end of the first slot wall and the longitudinal axis, and the first and second slot walls define the indentation.

41. The glow plug of claim 40, wherein the second ends of the first and second slot walls converge at a center of the indentation.

42. The glow plug of claim 39, wherein the body further includes a retaining lip positioned to lie between the top end of the body and the first end of the first slot wall.

43. The glow plug of claim 39, wherein the body further includes a glow plug clip-engaging surface having spaced-apart first and second ends, the second end of the glow plug clip-engaging surface is positioned to lie between the longitudinal axis and the first end of the glow plug clip-engaging surface.

44. The glow plug of claim 43, wherein the second end of the glow plug clip-engaging surface is contiguous with the top end of the body.

45. The glow plug of claim 43, wherein the body further includes a retaining lip positioned to lie between the first end of the first slot wall and the first end of the glow plug clip-engaging surface.

46. The glow plug of claim 35, wherein the indentation extends circumferentially about the body.

47. The glow plug of claim 35, wherein the indentation that defines the glow plug clip-retaining portion is spaced apart from the inner pole.

48. The glow plug of claim 35, wherein the body includes a mounting flange adapted to mount to a model engine and the indentation that defines the glow plug clip-retaining portion is spaced apart from the mounting flange.

49. The glow plug of claim 35, wherein the body includes a threaded portion adapted to mount to a model engine.

50. The glow plug of claim 35, wherein the indentation is a knurl.

51. The glow plug of claim 35, wherein the body includes an outer diameter of about 0.33 inch (0.84 cm) to 0.35 inch (0.89 cm).

52. The glow plug of claim 35, wherein the indentation defines a slot diameter of the body of about 0.295 inch (0.75 cm) to 0.325 inch (0.83 cm).

53. A glow plug for use in a model engine and for connecting to a glow plug clip, the glow plug comprising a coil having spaced apart first and second ends, a first conductor coupled to the first end of the coil, and a second conductor coupled to the second end of the coil, the second conductor including a body and a glow plug clip-retaining portion that extends circumferentially about the body.

54. The glow plug of claim 53, wherein the indentation is a semi-circular shaped groove in the body.

55. The glow plug of claim 53, wherein the indentation is a plurality of grooves in the body.

56. The glow plug of claim 53, wherein the body includes an outer surface facing away from the longitudinal axis, a top end, a bottom end, and a first slot wall, the first slot wall includes spaced-apart first and second ends, the first slot wall extends along an angle so that the second end of the first slot wall is positioned to lie between the first end of the first slot wall and the longitudinal axis, and the first slot wall defines the indentation.

57. The glow plug of claim 56, wherein the body further includes a second slot wall that includes spaced-apart first and second ends, the second slot wall extends along an angle so that the second end of the second slot wall is positioned to lie between the first end of the first slot wall and the longitudinal axis, and the first and second slot walls define the indentation.

58. The glow plug of claim 57, wherein the second ends of the first and second slot walls converge at a center of the indentation.

59. The glow plug of claim 56, wherein the body further includes a retaining lip positioned to lie between the top end of the body and the first end of the first slot wall.

60. The glow plug of claim 56, wherein the body further includes a glow plug clip-engaging surface having spaced-apart first and second ends, the second end of the glow plug clip-engaging surface is positioned to lie between the longitudinal axis and the first end of the glow plug clip-engaging surface.

61. The glow plug of claim 60, wherein the second end of the glow plug clip-engaging surface is contiguous with the top end of the body.

62. The glow plug of claim 60, wherein the body further includes a retaining lip positioned to lie between the first end of the first slot wall and the first end of the glow plug clip-engaging surface.

63. The glow plug of claim 53, wherein the indentation that defines the glow plug clip-retaining portion is spaced apart from the inner pole.

64. The glow plug of claim 53, wherein the body includes a mounting flange adapted to mount to a model engine and the indentation that defines the glow plug clip-retaining portion is spaced apart from the mounting flange.

65. The glow plug of claim 53, wherein the body includes a threaded portion adapted to mount to a model engine.

66. The glow plug of claim 53, wherein the indentation is a knurl.

67. The glow plug of claim 53, wherein the body includes an outer diameter of about 0.33 inch (0.84 cm) to 0.35 inch (0.89 cm).

68. The glow plug of claim 53, wherein the indentation defines a slot diameter of the body of about 0.295 inch (0.75 cm) to 0.325 inch (0.83 cm).

* * * * *